US007868853B2

(12) United States Patent
Choi

(10) Patent No.: US 7,868,853 B2
(45) Date of Patent: Jan. 11, 2011

(54) DRIVING DEVICE FOR PLASMA DISPLAY PANEL AND PLASMA DISPLAY DEVICE INCLUDING THE DRIVING DEVICE

(75) Inventor: Hak-ki Choi, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 658 days.

(21) Appl. No.: 11/936,616

(22) Filed: Nov. 7, 2007

(65) Prior Publication Data

US 2008/0143701 A1 Jun. 19, 2008

(30) Foreign Application Priority Data

Dec. 15, 2006 (KR) ..... 10-2006-0128679

(51) Int. Cl.
*G09G 3/28* (2006.01)

(52) U.S. Cl. ..... 345/60; 345/63; 345/67; 345/211; 315/169.1

(58) Field of Classification Search ..... 345/60–68, 345/211; 315/169.1–169.4
See application file for complete search history.

(56) References Cited

U.S. PATENT DOCUMENTS

| | | | | |
|---|---|---|---|---|
| 6,906,690 | B2 * | 6/2005 | Lim | 345/60 |
| 7,006,057 | B2 * | 2/2006 | Jin et al. | 345/60 |
| 7,109,951 | B2 * | 9/2006 | Kim et al. | 345/63 |
| 7,176,855 | B2 * | 2/2007 | Kang et al. | 345/60 |
| 7,212,176 | B2 * | 5/2007 | Kim | 345/60 |
| 7,286,102 | B2 * | 10/2007 | Yoon et al. | 345/60 |
| 7,460,087 | B2 * | 12/2008 | Kim et al. | 345/60 |
| 7,719,490 | B2 * | 5/2010 | Shim et al. | 345/68 |
| 2006/0187150 | A1 * | 8/2006 | Cho et al. | 345/68 |
| 2007/0040767 | A1 * | 2/2007 | Shim et al. | 345/68 |
| 2007/0171151 | A1 * | 7/2007 | Jung et al. | 345/67 |

FOREIGN PATENT DOCUMENTS

| | | |
|---|---|---|
| KR | 10-2004-0029690 | 4/2004 |
| KR | 10-2005-0042987 | 5/2005 |
| KR | 10-0528931 | 11/2005 |
| KR | 10-2006-0004172 | 1/2006 |

OTHER PUBLICATIONS

Korean Patent Abstracts, Publication No. 1020060004172 A, Published on Jan. 12, 2006, in the name of Cho.

Korean Patent Abstracts, Publication No. 1020040029690 A; Date of Publication: Apr. 8, 2004; in the name of Chang Hwan Koo et al.

Korean Patent Abstracts, Publication No. 1020050042987 A; Date of Publication: May 11, 2005; in the name of Joon Young Chio et al.

Korean Patent Abstracts, Publication No. 100528931 B1; Date of Publication: Nov. 9, 2005; in the name of Jin Boo Son et al.

Notice of Allowance dated Nov. 28, 2007, for corresponding Korean Patent Application No. 10-2006-0128679, indicating the relevance of the cited references.

Notice of Allowance with English Translation dated Nov. 28, 2007, for corresponding Korean Patent Application No. 10-2006-0128679. The Notice of Allowance was cited in an IDS on Feb. 27, 2008.

* cited by examiner

*Primary Examiner*—Kimnhung Nguyen
(74) *Attorney, Agent, or Firm*—Christie, Parker & Hale, LLP

(57) ABSTRACT

A driving device for a plasma display panel. The driving device generates rising and falling ramp signals having a respective constant slope regardless of a change in operating temperature. An optimal discharge voltage is maintained at high and low temperatures by the rising and falling ramp signals having a respective constant slope to secure an operation margin, thereby preventing a discharge degradation such as an incorrect discharge from occurring. Accordingly, this can cause the reliability of a plasma display device including the driving device to be enhanced.

20 Claims, 5 Drawing Sheets

DRIVING DEVICE FOR PLASMA DISPLAY PANEL AND PLASMA DISPLAY DEVICE INCLUDING THE DRIVING DEVICE

CROSS-REFERENCE TO RELATED APPLICATION

This application claims priority to and the benefit of Korean Patent Application No. 10-2006-0128679, filed on Dec. 15, 2006, in the Korean Intellectual Property Office, the entire content of which is incorporated herein by reference.

BACKGROUND

1. Field of the Invention

The present invention relates to a driving device for a plasma display panel.

2. Discussion of Related Art

A plasma display device is a flat panel display device, which displays characters or images by exciting a phosphor material using plasma obtained through a gas discharge. In comparison with a liquid crystal display (LCD) or a field emission display (FED), the plasma display device has higher luminance and emission efficiency, and wider viewing angle. Accordingly, plasma display devices are in the spotlight as a substitute for cathode ray tube (CRT) devices.

Plasma display panels (PDPs) are classified into direct current (referred to as 'DC' hereinafter) and alternating current (referred to as 'AC' hereinafter) PDPs depending upon driving waveform shapes and discharge cell structures. In a DC PDP, the electrodes are exposed in a discharge space, and electrical charges directly moving between the electrodes generate a discharge. In contrast, in an AC PDP, at least one electrode is covered with a dielectric layer, and wall charges (instead of electric charges directly moving between the electrodes) generate a discharge.

Additionally, PDPs may be classified into opposing discharge and surface discharge PDPs depending on the arrangement of electrodes. In an opposing discharge PDP, an address discharge for selecting discharge cells and a sustain discharge for sustaining a discharge are generated between a scan electrode (anode) and an address electrode (cathode). In a surface discharge PDP, an address discharge for selecting discharge cells is generated between an address electrode and a scan electrode crossing each other, and a sustain discharge for sustaining a discharge is generated between the scan electrode and a sustain electrode.

Referring now to FIG. 1, in a PDP such as those described above, a unit frame is divided into a plurality of sub fields, and the plasma display device is driven time divisionally to display a multiple gray scale image. Each of sub fields SF1~SF6 includes an initialization (or reset) period for making a charge state of a discharge cell uniform, a respective one of address periods A1~A6 for forming a wall charge on a discharge cell to be driven, and a respective one of sustain discharge periods S1~S6 for sustaining a discharge for display of an image. For the driving operation, a voltage signal having a waveform (e.g., a predetermined waveform) is applied to respective electrodes.

FIG. 1 shows a unit frame divided into 6 sub fields SF1~SF6. However, the greater the number of the sub fields, the better the quality of a displayed image. Accordingly, a unit frame divided into 10 to 12 or more sub fields has been studied. Namely, when the number of the sub fields is increased, pseudo profile noise, which is a main factor affecting image quality, is reduced, thereby enhancing the image quality.

Further, as an example of another factor of improving image quality, there is an operation margin security of a plasma display panel. This will be described in more detail with regards to a ramp reset method. According to the method, in a ramp reset being performed during an initialization period PR, after positive wall charges have been formed, wall charges are erased except for suitable wall charges that allow for a low voltage address operation to be performed. As shown in FIG. 2, the method uses a voltage signal including a ramp up signal (or rising ramp signal) A and a ramp down signal (or falling ramp signal) B.

FIG. 3 is a circuit diagram of a driving device for a conventional plasma display panel as an example of a circuit for generating ramp signals as shown in FIG. 2. That is, FIG. 3 shows a portion of a drive circuit using a capacitive load to operate a switch serving as a constant current source.

Suppose, for example, that a voltage applied to a plasma display panel is Vc. Since a voltage of a rising ramp signal and that of a falling ramp signal are linearly increased and decreased, respectively, with respect to a time axis, a time derivative of the voltage Vc is a constant K, as expressed by the following equation.

$$V_c = \frac{1}{C}\int i dt \qquad (1)$$

$$\frac{dV_c}{dt} = \frac{1}{C} \times i = K$$

In equation (1), C has a constant value as a capacitance of the display panel. Accordingly, in order to output a ramp signal as shown in FIG. 2, an electrical current i introduced to the display panel should be constant.

With reference to FIG. 3, a resistor R1 is connected between a control signal input terminal S1 and a gate of the transistor Q1. A capacitor C1 is connected between a gate and a drain of the transistor Q1. The capacitor Cgd shown in FIG. 3 is a parasitic capacitance between the gate and the drain of the transistor Q1, and the capacitor Cgs is a parasitic capacitance between the gate and the source of the transistor Q1.

To completely turn on the transistor Q1, the capacitor Cgs between the gate and the source should be charged, and the capacitor Cgd between the gate and the drain should be charged. Here, because the capacitor Cgs is charged by a charge of the capacitor Cgd, the capacitor C1 is added. Accordingly, an interval from a time in which a voltage exceeding a threshold voltage of the transistor Q1 is supplied between the gate and the source thereof to a time in which the transistor Q1 is completely turned on, can be extended to some degree. Accordingly, when the capacitor Cgs is charged through a path ① and the transistor Q1 is turned on a little, a gate current is introduced to the display panel through a path ②. Further, when the capacitor Cgs starts to be discharged to turn off the transistor Q1, the transistor Q1 functions as a constant current source by a negative feed back through the paths ① and ②.

However, as described earlier, the conventional driving device for generating the ramp signals has components (e.g., capacitors and transistors) having performance characteristics that are highly temperature dependent. Accordingly, when the operating temperature changes, a slope of a ramp signal also changes, as shown in FIG. 4. Namely, in the plasma display panel, as an operation time progresses, the operating temperature is increased. When the temperature is increased, an insulative property of a dielectric material is degraded such that a leakage of wall charges occurs, or a movement of the wall charges is increased in a discharge space to easily cause recombinations, thereby causing the leakage of the wall charges. Accordingly, when a voltage signal lower than a level required in a high operating temperature is applied, discharge errors such as an incorrect discharge in which a selected pixel is not operated, may occur.

SUMMARY OF THE INVENTION

An aspect of the present invention is directed towards a driving device for a plasma display panel, the driving device being for generating ramp signals having a respective constant slope.

In one embodiment, a driving device for a plasma display panel, the display panel including a plurality of discharge cells defined by a plurality of first electrodes, a plurality of second electrodes and a plurality of third electrodes crossing the first and second electrodes, includes a sustain voltage supply for applying a sustain voltage to the first electrodes. The driving device also includes a ramp signal supply for applying a rising ramp signal and a falling ramp signal to the first electrodes, the rising ramp signal increasing from the sustain voltage at a first slope and the falling ramp signal decreasing from the sustain voltage at a second slope. The driving device also includes a scan voltage supply for applying a scan voltage to the first electrodes. The ramp signal supply includes: a first constant current source coupled to a voltage source; a second constant current source; a first resistor coupled between the first constant current source and the second constant current source, the first resistor having a first resistance varying according to an operating temperature; and a second resistor coupled between the second constant current source and a ground terminal, the second resistor having a second resistance varying according to the operating temperature.

BRIEF DESCRIPTION OF THE DRAWINGS

These and/or other aspects and features of the invention will become apparent and more readily appreciated from the following description of exemplary embodiments, taken in conjunction with the accompanying drawings of which.

DETAILED DESCRIPTION

Figure 1:
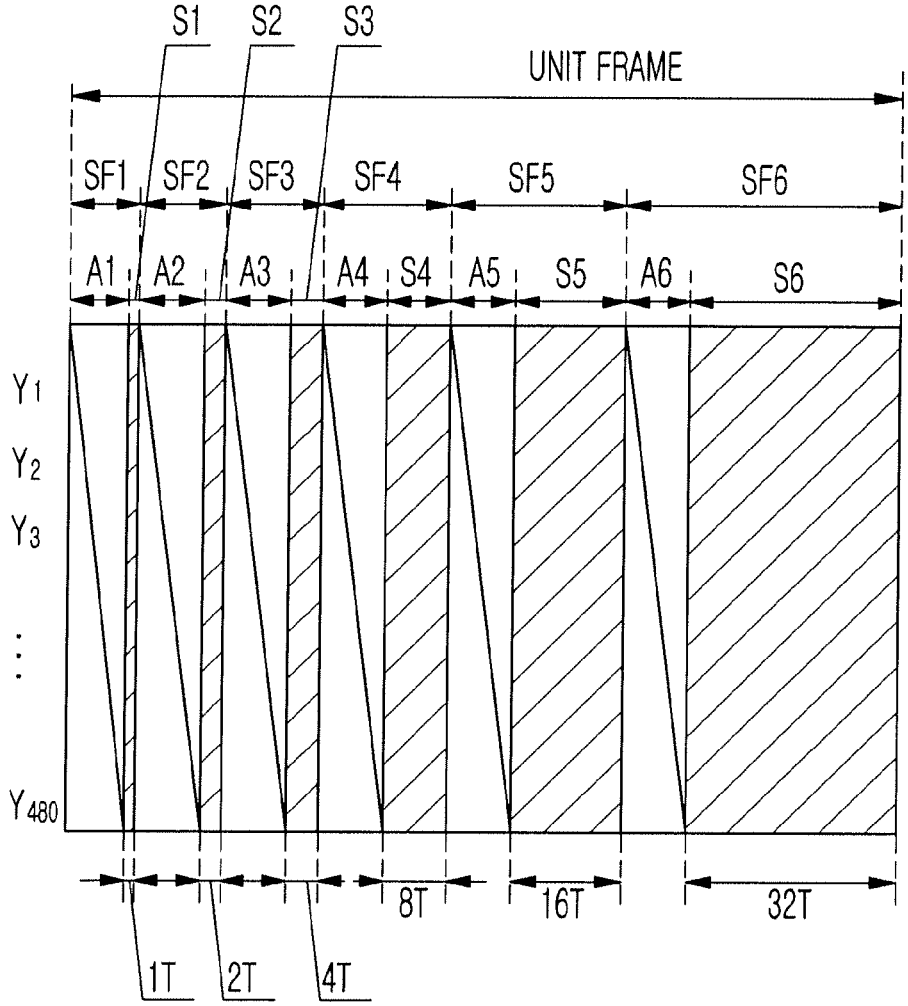
FIG. 1 is a timing diagram showing a unit frame for a multiple gray scale of a plasma display device.
Figure 2:
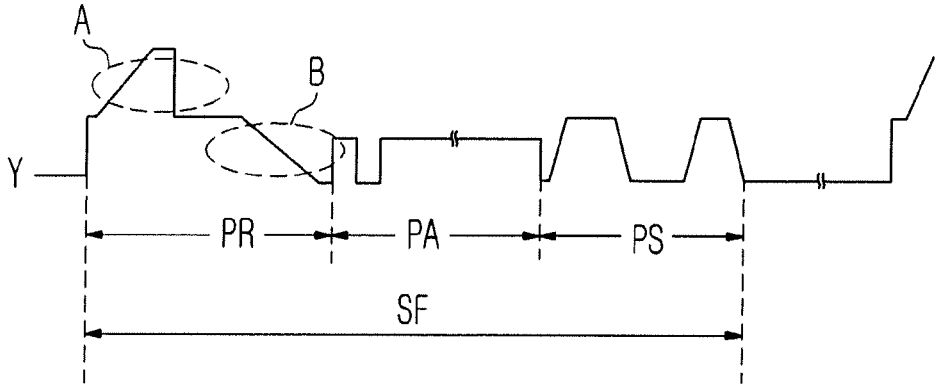
FIG. 2 is a waveform diagram for illustrating an operation of a conventional plasma display device.
Figure 3:
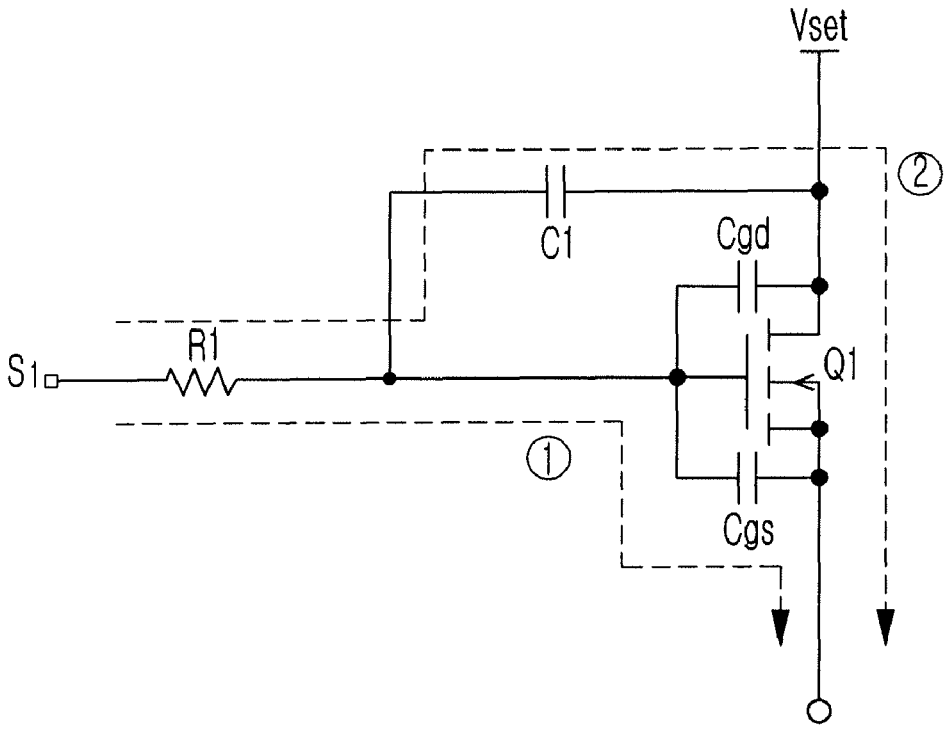
FIG. 3 is a circuit diagram of a driving device for a conventional plasma display panel.
Figure 4:
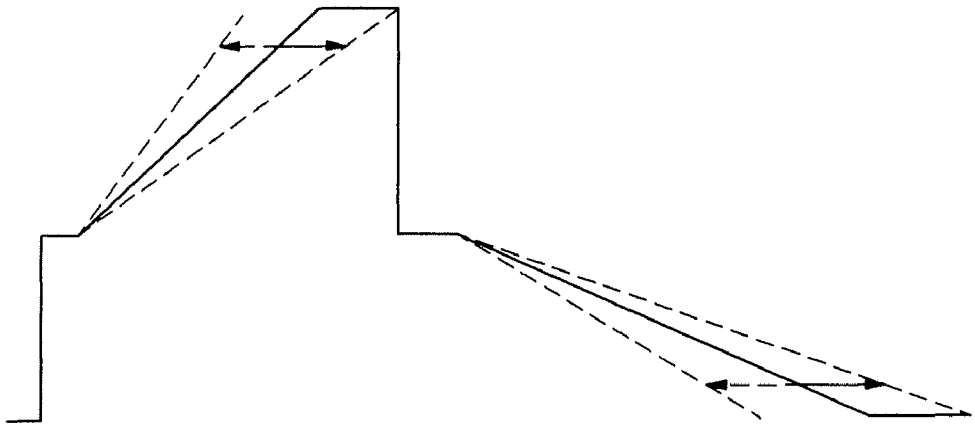
FIG. 4 is a timing diagram of ramp pulses (i.e., rising and falling signals) shown in FIG. 2.

Hereinafter, exemplary embodiments of the present invention will be described with reference to the accompanying drawings. Here, when a first element is described as being connected to a second element, the first element may be directly connected to the second element or may alternatively be indirectly connected to the second element via one or more other elements. Further, some of the elements that are not essential to the complete understanding of the invention are not described below to improve clarity. Also, like reference numerals refer to like elements throughout.

Figure 5:
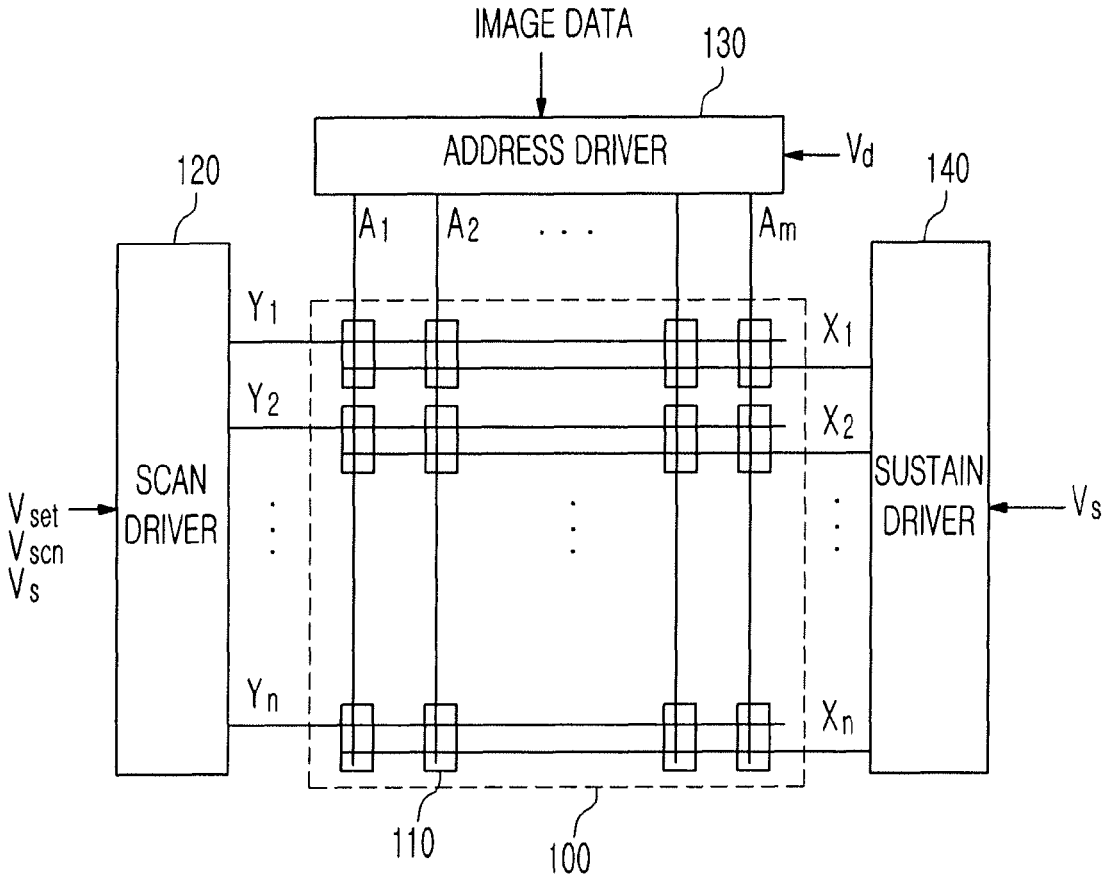
FIG. 5 is a block diagram showing a plasma display device according to an embodiment of the present invention.

FIG. 5 is a block diagram of a plasma display device according to an embodiment of the present invention.

The plasma display panel 100 includes a plurality of discharge cells 110 defined by a plurality of scan electrodes $Y_1$, $Y_2, \ldots, Y_n$, a plurality of sustain electrodes $X_1, X_2, \ldots, X_n$, and a plurality of address electrodes $A_1, A_2, \ldots, A_m$. Here, the plurality of scan electrodes $Y_1, Y_2, \ldots, Y_n$ and the plurality of sustain electrodes $X_1, X_2, \ldots, X_n$ are arranged to extend parallel to each other. The plurality of address electrodes $A_1$, $A_2, \ldots, A_m$ are arranged to cross the plurality of scan electrodes $Y_1, Y_2, \ldots, Y_n$, and the plurality of sustain electrodes $X_1, X_2, \ldots, X_n$.

The scan electrodes $Y_1, Y_2, \ldots, Y_n$ are connected to a scan driver 120, the address electrodes $A_1, A_2, \ldots, A_m$ are connected to an address driver 130, and the sustain electrodes $X_1$, $X_2, \ldots, X_n$ are connected to a sustain driver 140.

The plasma display device may further include an image processor, a logic controller, and a drive voltage generator. The image processor receives an external analog image signal and generates a digital image signal including, for example, red (R), green (G), and blue (B) image data, each being 8-bit data, a clock signal, and vertical and horizontal synchronous signals. The logic controller generates a control signal according to an internal image signal provided from the image processor. The drive voltage generator generates a set up voltage Vset, a scan voltage Vscan, a sustain voltage Vs, and a data voltage Vd.

Figure 6:
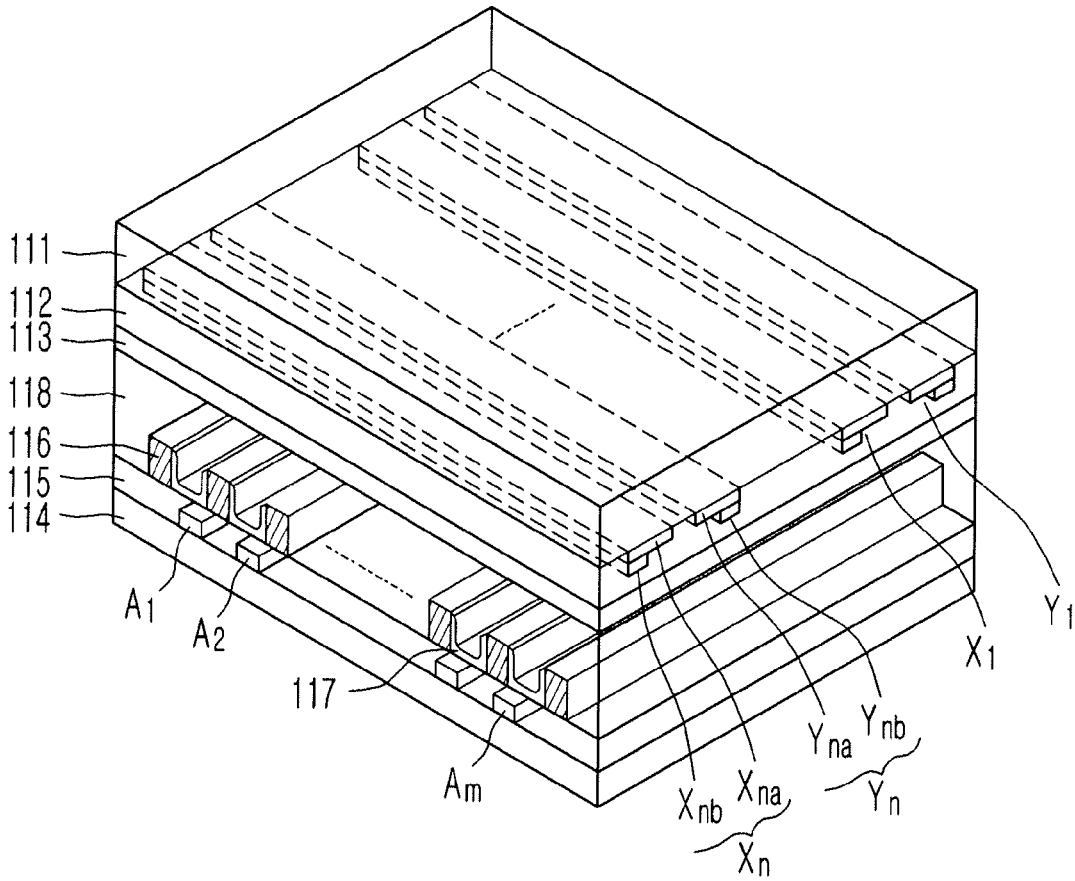
FIG. 6 is a perspective view of a plasma display panel shown in FIG. 5.

FIG. 6 is a perspective view of a surface emitting type plasma display panel, which is an example of the plasma display panel 100 shown in FIG. 5.

With reference to FIG. 6, the plurality of sustain electrodes $X_1, X_2, \ldots, X_n$ and the plurality of scan electrodes $Y_1$, $Y_2, \ldots, Y_n$ are formed on a first substrate 111 to extend parallel to each other and are covered by a dielectric layer 112 and a passivation layer 113. The passivation layer 113 prevents the dielectric layer 112 from being damaged due to plasma, and is formed, for example, of magnesium oxide (MgO), which may increase emission efficiency of secondary electrons. The sustain electrodes $X_1, X_2, \ldots, X_n$ and the scan electrodes $Y_1, Y_2, \ldots, Y_n$ are composed of transparent electrodes $X_{na}$ and $Y_{na}$, respectively, that are formed, for example, of indium tin oxide (ITO) and are further composed of metal electrodes $X_{nb}$ and $Y_{nb}$, respectively, for increasing conductivity.

On a second substrate 114, the plurality of address electrodes $A_1, A_2, \ldots, A_m$ are formed and are covered with a dielectric layer 115. Partition walls 116 are formed on the dielectric layer 115 between the plurality of address electrodes $A_1, A_2, \ldots, A_m$ and extend parallel to the address electrodes $A_1, A_2, \ldots, A_m$. Phosphorous layers 117 are formed at both side surfaces of the partition walls 116 and on the dielectric layer 115. The first substrate 111 and the second substrate 114 are adhered to each other so that the scan electrodes $Y_1, Y_2, \ldots, Y_n$ and the sustain electrodes $X_1, X_2, \ldots, X_n$ are orthogonal to the address electrodes $A_1, A_2, \ldots, A_m$. Then, gas for generating plasma is sealed in a closed discharge space 118 formed by the partition walls 116, thereby defining a plurality of discharge cells 110. By way of example, inert gas mixtures such as He+Xe, Ne+Xe, or He+Xe+Ne may be used as the gas for generating plasma.

Figure 7:
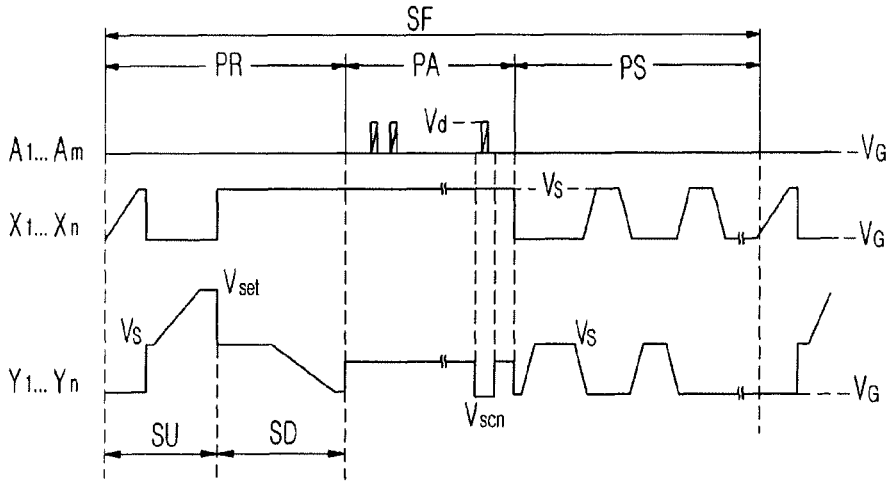
FIG. 7 is a waveform diagram for illustrating an operation of a plasma display device according to an embodiment of the present invention.

As shown in FIG. 1, for driving the plasma display panel having a construction such as that described above, a unit frame is time-divided into a plurality of sub fields SF1 to SF6. In each sub field, an initialization period (or reset period) PR, an address period PA, and a sustain discharge period PS are sequentially performed by a voltage signal having a waveform such as that shown in FIG. 7. Accordingly, the plasma display panel is driven to display an image having a desired gradation.

First, the initialization period PR is for erasing wall charges of discharge cells which were formed by a sustain discharge of a previous sub field and makes a charge state of the discharge cells to be uniform so that the discharge cells can be stably selected in the address period PA. The initialization period PR includes a set up period SU and a set down period SD. A rising ramp signal (or ramp up signal) is applied during the set up period SU. A falling ramp signal (or ramp down signal) is applied during the set down period SD.

For example, during the set up period SU, a rising ramp signal is applied to all scan electrodes $Y_1, Y_2, \ldots, Y_n$. The rising ramp signal is increased from a sustain voltage Vs to a set up voltage Vset at a constant slope. A dark discharge is generated by the rising ramp signal to form positive wall charges on the address electrodes $A_1, A_2, \ldots, A_m$ and the sustain electrodes $X_1, X_2, \ldots, X_n$, and to form negative wall charges on the scan electrodes $Y_1, Y_2, \ldots, Y_n$. Here, during the dark discharge, light is not generated at the discharge cells. While the wall charges are described as being formed on electrodes throughout the disclosure, the wall charges in practice are formed, for example, on the dielectric or the passivation layer 113.

During the set down period SD, a falling ramp signal is applied to all the scan electrodes $Y_1, Y_2, \ldots, Y_n$. The falling ramp signal includes positive voltages that are lower than the set up voltage Vset, for example, voltages which are reduced from the sustain voltage Vs to a ground voltage $V_G$ or a negative voltage (e.g., a predetermined negative voltage) at a slope (e.g., a predetermined slope). Due to the falling ramp signal, excessive wall charges formed during the set up period are erased such that wall charges in discharge cells are set up to be uniform for stably generating address discharges.

The address period PA is for forming wall charges at a discharge cell to be driven. During the address period PA, a scan voltage Vscn is sequentially applied to the scan electrodes $Y_1, Y_2, \ldots, Y_n$. Concurrently, a data voltage Vd is applied to the address electrodes $A_1, A_2, \ldots$ and $A_m$. Where a wall voltage (e.g., a predetermined wall voltage) is formed during the initialization period PR, a difference in potential between the scan voltage Vscn and the data voltage Vd generates an address discharge in a discharge cell to which the data voltage Vd is applied. Accordingly, a quantity of wall charges sufficient to generate a sustain discharge is formed in the selected discharge cell. Here, the sustain voltage Vs is applied to the sustain electrodes $X_1, X_2, \ldots, X_n$ to reduce a voltage difference between the sustain electrodes and the scan electrodes $Y_1, Y_2, \ldots, Y_n$, thereby preventing an incorrect discharge from being generated.

The sustain discharge period PS is for generating a discharge in selected discharge cells to display an image. Sustain pulses having a sustain voltage Vs are alternately applied to the scan electrodes $Y_1, Y_2, \ldots, Y_n$ and the sustain electrodes $X_1, X_2, \ldots, X_n$ of discharge cells. As a sustain voltage Vs is added to a wall voltage of the selected discharge cells, a discharge is generated between the scan electrodes $Y_1, Y_2, \ldots, Y_n$ and the sustain electrodes $X_1, X_2, \ldots, X_n$ and maintained with every sustain pulse so that an image is displayed.

When the sustain discharge period PS is terminated, a voltage having a low level is applied to all the sustain electrodes $X_1, X_2, \ldots, X_n$ to erase wall charges remaining in the discharge cells.

Figure 8:
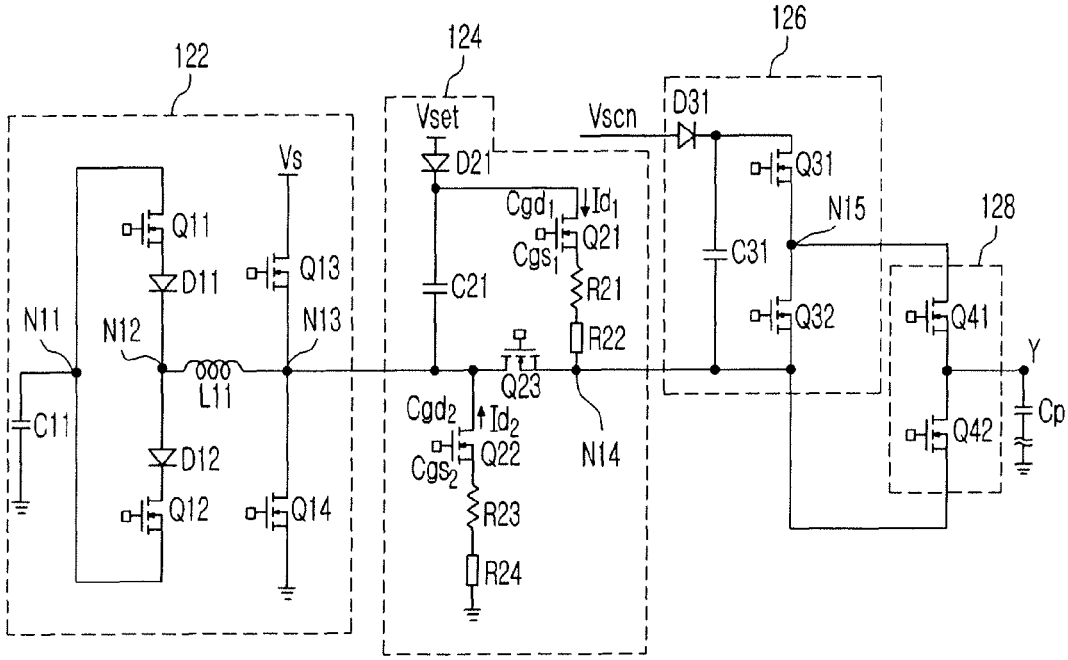
FIG. 8 is a circuit diagram of a driving device of an embodiment of the present invention.

FIG. 8 is a circuit diagram of a driving device, i.e., the scan driver 120 shown in FIG. 5, which provides ramp signals of constant slope regardless of a change in operating temperature. Operating temperature as used herein refers to the temperature of the display panel while in operation.

The scan driver 120 includes a sustain pulse supply (or sustain voltage supply) 122, a ramp pulse supply (or ramp signal supply) 124, a scan voltage supply 126, and an output unit 128. The sustain voltage supply 122 applies a sustain voltage Vs to the scan electrodes $Y_1, Y_2, \ldots, Y_n$. The ramp signal supply 124 applies a ramp up signal (or rising ramp signal) and a ramp down signal (or falling ramp signal) to the scan electrodes $Y_1, Y_2, \ldots, Y_n$. Here, the ramp up signal is obtained by increasing the sustain voltage at a slope (e.g., a predetermined slope), and the ramp down signal is obtained by reducing the sustain voltage at a slope (e.g., a predetermined slope). The scan voltage supply 126 applies a scan voltage Vscn to the scan electrodes $Y_1, Y_2, \ldots, Y_n$. The output unit 128 transfers the sustain voltage Vs, the ramp up signal, the ramp down signal, and the scan voltage to the scan electrodes $Y_1, Y_2, \ldots, Y_n$. Capacitors (see, for example, Cp, of FIG. 8) are formed between the scan electrodes $Y_1, Y_2, \ldots, Y_n$ and the sustain electrodes $X_1, X_2, \ldots, X_n$ of the display panel.

The sustain voltage supply 122 includes a capacitor C11, a first transistor Q11, a first diode D11, a second transistor Q12, a second diode D12, an inductor L11, a third transistor Q13, and a fourth transistor Q14. The capacitor C11 is coupled between a first node N11 and ground. The first transistor Q11 and the first diode D11 are coupled in series between the first node N11 and a second node N12. The second transistor Q12 and the second diode D12 are coupled in series between the first node N11 and the second node N12. The inductor L11 is coupled between the second node N12 and the ramp down signal output node (or third node) N13. The third transistor Q13 is coupled between the voltage source Vs and the ramp down signal output node N13. The fourth transistor Q14 is coupled between the ramp down signal output node N13 and ground.

Where the capacitor C11 is charged with a voltage of Vs/2, e.g., during the sustain discharge period PS, the first transistor Q11 is turned on to increase a potential of the third node N3 to the scan voltage Vs by a voltage of the capacitor C11 and a resonance of the inductor L11. When the potential of the third node N13 reaches the scan voltage, the third transistor Q13 is turned on, so that a potential of the third node N13 is maintained at the scan voltage Vs by the voltage source Vs, and the panel capacitor Cp is charged due to the turning on of the third transistor Q13. Next, when the second transistor Q12 is turned on, a voltage charged in the panel capacitor Cp is returned to the capacitor C11 by the resonance of the inductor L11. Accordingly, the capacitor C11 is charged with a voltage of Vs/2, and the fourth transistor Q14 is turned on so that the third node N13 is maintained at ground potential. One or more sustain pulses of a sustain voltage Vs are applied to the scan electrodes $Y_1, Y_2, \ldots, Y_n$ of the discharge cells during the aforementioned operations.

The ramp signal supply 124 includes a transistor Q21, a resistor R21, a resistor R22, a capacitor C21, a transistor Q22, a resistor R23, a resistor R24, and a transistor Q23. A drain of the transistor Q21 is coupled to a voltage source Vset through a diode D21. The resistor R21 is coupled to a source of the transistor Q21. The resistor R22 is coupled between the resistor R21 and the ramp up signal output node N14. A resistance of the resistor R22 changes according to temperature (i.e., operating temperature). The capacitor C21 is coupled between a drain of the transistor Q21 and the ramp down signal output node N13. A drain of the transistor Q22 is coupled to the ramp down signal output node N13. The resistor R23 is coupled to a source of the transistor Q22. The resistor R24 is coupled between the resistor R23 and ground, and a resistance of the resistor R24 changes according to temperature (i.e. operating temperature). The transistor Q23 is coupled between the ramp down signal output node N13 and the ramp up signal output node N14. The transistors Q21 to Q23 operate according to respective control signals. Furthermore, the capacitors Cgd1, Cgd2 are parasitic capacitances between respective gates and drains of the transistors Q21 and Q22. Capacitors Cgs1, Cgs2 are parasitic capacitances between respective gates and sources of the transistors Q21 and Q22.

During a set up period SU of an initialization period PR, the ramp up signal is applied to all the scan electrodes $Y_1, Y_2, \ldots, Y_n$. During a set down period SD of the initialization period PR, the ramp down signal is applied to all the scan electrodes $Y_1, Y_2, \ldots, Y_n$. The transistor Q21 and the resistor R21, and the transistor Q22 and the resistor R23 each function as a constant current source to generate the respective ramp signals.

In more detail, when a control signal having a voltage (e.g., a predetermined voltage) is applied to a gate of the transistor Q21, the transistor Q21 is turned on by a charged voltage of the capacitor Cgs1, so that an electrical current Id1 starts to flow from the voltage source Vset to a drain of the transistor Q21 through the diode D21, and the capacitor Cgd1 is charged to rapidly increase the magnitude of the drain current Id1. Here, since a potential of the control signal is constant and has, for example, a voltage ranging from 12V to 18V, a voltage charged in the capacitor Cgs1 is reduced by a voltage drop over the resistor R21. When the voltage of the capacitor Cgs1 is reduced, the transistor Q21 is turned off to reduce the magnitude of the drain current Id1. This causes the voltage drop over the resistor R21 to be also reduced. Accordingly, the voltage charged in the capacitor Cgs1 is increased to again turn on the transistor Q21. By the negative feedback effect, the transistor Q21 functions as a constant current source to generate a ramp up signal having a slope (e.g., a predetermined slope).

Since the generation of the ramp down signal by the transistor Q22 and the resistor R23 functioning as a constant current source is substantially similar to the generation of the ramp up signal as described above, a detailed description of the generation of the ramp down signal will not be presented below.

However, when the transistor Q21 and the resistor R21, and the transistor Q22 and the resistor 23 generate the respective ramp signals, respective slopes of the ramp signals change according to an operating temperature of components (e.g., the capacitor and the transistor). Here, each component has a performance characteristic that is highly temperature dependent, that is, a characteristic of the component changes according to the operating temperature. Accordingly, in embodiments of the present invention, resistors R22 and R24 are serially connected to the resistors R21 and R23, respectively, in order to generate ramp signals having a respective constant slope regardless of the operating temperature. Here, the respective resistances of the resistors R22 and R24 change according to the operating temperature.

For example, a capacitance of the panel capacitor Cp is reduced with an increase in operating temperature, e.g., as illustrated in Equation 1, such that when a constant drain current flows, when an operating temperature is increased, a slope of the ramp signal tends to be increased. However, according to embodiments of the present invention, as operating temperature is increased, resistances of the resistors R22 and R24 are also increased. Accordingly, voltage drops over the resistors R21 and R22, and R23 and R24 are increased such that a slope of the ramp signal is not increased. On the other hand, the capacitance of the panel capacitor Cp is increased with a decrease in operating temperature such that the slope of the ramp signal tends to be reduced. However, as the operating temperature is reduced, the resistances of the resistors R22 and R24 are reduced. Accordingly, voltage drops over the resistors R21 and R22, and R23 and R24 are reduced so as not to reduce the slope of the ramp signal. As such, the slope of the ramp signal maintains constant irrespective of the operating temperature.

In this embodiment, positive temperature coefficient (referred to as 'PTC' hereinafter) thermistors can be used as resistors R22 and R24. Here, as the operating temperature increases, resistance values of the resistors R22 and R24 are increased. However, in another embodiment, when a capacitance of the panel capacitor Cp has a characteristic of increasing at a high operating temperature, negative temperature coefficient (referred to as 'NTC' hereinafter) thermistors can be used as resistors R22 and R24. Here, as the operating temperature increases, resistance values of the resistors R22 and R24 are reduced.

The scan voltage supply 126 includes a diode D31, a first transistor Q31, a second transistor Q32, and a capacitor C31. The diode D31 is connected to a voltage source Vscn. The first transistor Q31 is coupled between the diode D31 and an output node N15. The second transistor Q32 is coupled between the output node N15 and the ramp up signal output node N14. The capacitor C31 is coupled between the diode D31 and the ramp up signal output node N14. The first and second transistors Q31 and Q32 operate according to respective control signals.

During the address period PA, the first transistor Q41 is turned on according to a control signal to apply the scan voltage Vscn to the scan electrodes $Y_1, Y_2, \ldots, Y_n$.

The output section 128 includes a first transistor Q41 and a second transistor Q42. The first transistor Q41 is coupled between the node N15 and the scan electrodes $Y_1, Y_2, \ldots, Y_n$. The second transistor Q42 is coupled between the node N14 and the scan electrodes $Y_1, Y_2, \ldots, Y_n$. The first and second transistors Q41 and Q42 operate according to respective control signals. According to the control signals, the first and second transistors Q41 and Q42 are respectively turned on to transfer the sustain voltage Vs, the ramp up signal, the ramp down signal, and the scan voltage to the scan electrodes $Y_1, Y_2, \ldots, Y_n$.

As described above, the driving device according to exemplary embodiments of the present invention generates a ramp signal having a constant slope regardless of a change in operating temperature. An optimal discharge voltage is maintained at high and low temperatures due to the ramp signal having a constant slope to secure an operation margin, thereby preventing a discharge degradation such as an incorrect or erroneous discharge from occurring. Accordingly, this can cause the reliability of the plasma display device to be enhanced.

Although a few embodiments of the present invention have been shown and described, it would be appreciated by those skilled in the art that changes might be made in these embodiments without departing from the principles and spirit of the invention, the scope of which is defined in the claims and their equivalents.

What is claimed is:

1. A driving device for a plasma display panel including a plurality of discharge cells defined by a plurality of first electrodes, a plurality of second electrodes, and a plurality of third electrodes crossing the first and second electrodes, the driving device comprising:

a sustain voltage supply for applying a sustain voltage to the first electrodes;

a ramp signal supply for applying a rising ramp signal and a falling ramp signal to the first electrodes, the rising ramp signal increasing from the sustain voltage at a first slope and the falling ramp signal decreasing from the sustain voltage at a second slope; and a scan voltage supply for applying a scan voltage to the first electrodes, wherein the ramp signal supply comprises:

a first constant current source coupled to a voltage source;

a second constant current source;

a first resistor coupled between the first constant current source and the second constant current source, the first resistor having a first resistance varying according to an operating temperature; and a second resistor coupled between the second constant current source and a ground terminal, the second resistor having a second resistance varying according to the operating temperature.

2. The driving device as claimed in claim 1, wherein the sustain voltage supply comprises:

a capacitor having a first terminal, and a second terminal coupled to the ground terminal;

an inductor having a first terminal and a second terminal;

a first transistor and a first diode coupled in series between the first terminal of the inductor and the first terminal of the capacitor;

a second transistor and a second diode coupled in series between the first terminal of the inductor and the first terminal of the capacitor;

a third transistor coupled between a sustain voltage source and the second terminal of the inductor; and a fourth transistor coupled between the second terminal of the inductor and the ground terminal.

3. The driving device as claimed in claim 1, wherein the first constant current source comprises:

a transistor having a drain electrode coupled with the voltage source; and a third resistor coupled to a source electrode of the transistor.

4. The driving device as claimed in claim 1, wherein the second constant current source comprises:

a transistor having a drain electrode coupled with the first resistor; and a third resistor coupled between a source electrode of the transistor and the second resistor.

5. The driving device as claimed in claim 1, wherein the ramp signal supply further comprises a transistor coupled between the second constant current source and the first resistor.

6. The driving device as claimed in claim 1, wherein the ramp signal supply further comprises:

a diode coupled between the voltage source and the first constant current source; and a capacitor coupled between the diode and the second constant current source.

7. The driving device as claimed in claim 1, wherein the first resistor comprises a first thermistor, wherein the second resistor comprises a second thermistor, wherein the first resistance has a first characteristic of increasing as the operating temperature is increased, and wherein the second resistance has a second characteristic of increasing as the operating temperature is increased.

8. The driving device as claimed in claim 1, wherein the first resistor comprises a first thermistor, wherein the second resistor comprises a second thermistor, wherein the first resistance has a first characteristic of increasing as the operating temperature is reduced, and wherein the second resistance has a second characteristic of increasing as the operating temperature is reduced.

9. The driving device as claimed in claim 1, wherein the scan voltage supply comprises:

a diode having an anode coupled to a second voltage source;

a capacitor having a first terminal and a second terminal, the first terminal being coupled to a cathode of the diode; and a first transistor and a second transistor coupled between the cathode of the diode and the second terminal of the capacitor.

10. The driving device as claimed in claim 1, further comprising an output unit for transferring the sustain voltage, the rising ramp signal, the falling ramp signal, and the scan voltage to the first electrodes.

11. The driving device as claimed in claim 10, wherein the output unit comprises:

a first transistor coupled between an output terminal of the scan voltage supply and a corresponding one of the first electrodes; and a second transistor coupled between an output terminal of the ramp signal supply and the corresponding one of the first electrodes.

12. A driving device for a plasma display panel including a plurality of panel capacitances formed by a plurality of first electrodes and a plurality of second electrodes, and a plurality of third electrodes crossing the first and second electrodes, the driving device comprising:

a sustain voltage supply for applying a sustain voltage to the first electrodes; and a ramp signal supply for applying a rising ramp signal increasing linearly from the sustain voltage at a first slope and for applying a falling ramp signal decreasing linearly from the sustain voltage at a second slope;

wherein at least one of the panel capacitances varies according to an operating temperature, and wherein the ramp signal supply comprises:

a first constant current source coupled to a voltage source;

a second constant current source;

first means coupled between the first constant current source and the second constant current source and for countering the variance of the at least one of the panel capacitances to maintain the first slope to be constant according to the operating temperature; and second means coupled between the second constant current source and a ground terminal and for countering the variance of the at least one of the panel capacitances to maintain the second slope to be constant according to the operating temperature.

13. The driving device of claim 12, wherein the first means comprises a first resistor, and wherein the second means comprises a second resistor.

14. The driving device of claim 12, wherein the at least one of the panel capacitances increases as the operating temperature increases, wherein the first means comprises a first negative temperature coefficient (NTC) thermistor, and wherein the second means comprises a second negative temperature coefficient (NTC) thermistor.

15. The driving device of claim 12, wherein the at least one of the panel capacitances decreases as the operating temperature increases, wherein the first means comprises a first positive temperature coefficient (PTC) thermistor, and wherein the second means comprises a second positive temperature coefficient (PTC) thermistor.

16. A plasma display device comprising:

a plurality of scan electrodes and a plurality of sustain electrodes;

a plurality of address electrodes crossing the scan electrodes and the sustain electrodes; and a driving device comprising:

a sustain voltage supply for applying a sustain voltage to the sustain electrodes;

a ramp signal supply for applying a rising ramp signal and a falling ramp signal to the sustain electrodes, the rising ramp signal increasing from the sustain voltage at a first slope and the falling ramp signal decreasing from the sustain voltage at a second slope; and a scan voltage supply for applying a scan voltage to the sustain electrodes, wherein the ramp signal supply comprises:

a first constant current source coupled to a voltage source;

a second constant current source;

a first resistor coupled between the first constant current source and the second constant current source, the first resistor having a first resistance varying with respect to an operating temperature; and a second resistor coupled between the second constant current source and a ground terminal, the second resistor having a second resistance varying according to the operating temperature.

17. The plasma display device of claim 16, wherein the ramp signal supply further comprises a transistor coupled between the second constant current source and the first resistor.

18. The plasma display device of claim 16, wherein the ramp signal supply further comprises:

a diode coupled between the voltage source and the first constant current source; and a capacitor coupled between the diode and the second constant current source.

19. The plasma display device of claim 16, wherein the first resistor comprises a first thermistor, wherein the second resistor comprises a second thermistor, wherein the first resistance has a first characteristic of increasing as the operating temperature is increased, and wherein the second resistance has a second characteristic of increasing as the operating temperature is increased.

20. The plasma display device of claim 16, wherein the first resistor comprises a first thermistor, wherein the second resistor comprises a second thermistor, wherein the first resistance has a first characteristic of increasing as the operating temperature is reduced, and wherein the second resistance has a second characteristic of increasing as the operating temperature is reduced.

* * * * *